United States Patent [19]

Wieland

[11] 4,391,192

[45] Jul. 5, 1983

[54] BEARING ARRANGEMENT FOR AN INK FOUNTAIN IN A ROTARY PRINTING MACHINE

[75] Inventor: Erich G. Wieland, Würzburg, Fed. Rep. of Germany

[73] Assignee: Koenig & Bauer AG, Wurzburg, Fed. Rep. of Germany

[21] Appl. No.: 300,850

[22] Filed: Sep. 10, 1981

[30] Foreign Application Priority Data

Sep. 10, 1980 [DE] Fed. Rep. of Germany ..... 3033998

[51] Int. Cl.[3] ..... B41F 31/06; B41L 27/08

[52] U.S. Cl. ..... 101/350; 101/363

[58] Field of Search ..... 101/363, 364, 350, 351, 101/352, 348, 349, 207, 208, 210, 347, 355, 356, 360, 340, 344

[56] References Cited

U.S. PATENT DOCUMENTS

| | | | |
|---|---|---|---|
| 1,417,652 | 5/1922 | Wood | 101/219 |
| 2,451,634 | 10/1948 | Ranger | 101/364 |
| 2,751,843 | 6/1956 | Faeber | 101/349 |
| 2,887,049 | 5/1959 | Mueller | 101/364 |
| 2,929,321 | 3/1960 | Newbegin | 101/364 |
| 2,948,217 | 8/1960 | Witt | 101/364 |
| 3,318,239 | 5/1967 | Wintzer | 101/364 |
| 3,556,008 | 1/1971 | Branfield | 101/350 |
| 4,058,058 | 11/1977 | Hantscho | 101/365 |
| 4,170,177 | 10/1979 | Iida et al. | 101/169 |

FOREIGN PATENT DOCUMENTS

| | | |
|---|---|---|
| 1290154 | 3/1967 | Fed. Rep. of Germany . |
| 2814889 | 10/1978 | Fed. Rep. of Germany . |

*Primary Examiner*—J. Reed Fisher

*Attorney, Agent, or Firm*—Jones, Tullar & Cooper

[57] ABSTRACT

A bearing arrangement for an ink fountain in a rotary printing machine is disclosed. An ink fountain roller is carried in bearings in the side frames of the printing machine. Ball bearings are secured to support journals of the roller interiorly of the side frames and carry supporting rings which have grooved peripheral surfaces. An ink fountain is resiliently pivotably carried by the side frames and is secured to the roller journals. Securement is accomplished by flexible wire rope or the like which is secured at one end to the ink fountain, passes around the periphery of the supporting rings carried by the roller journals and is held by an over-center latch on the ink fountain. Actuation of the latch secures the ink fountain to the roller. The bearing arrangement in accordance with the present invention reduces ink fountain roller deflection and gives more uniform ink application.

8 Claims, 3 Drawing Figures

BEARING ARRANGEMENT FOR AN INK FOUNTAIN IN A ROTARY PRINTING MACHINE

FIELD OF THE INVENTION

The present invention is directed to a bearing arrangement for an ink fountain in a rotary printing machine. More particularly, the present invention is directed to a bearing arrangement to provide a support for a pivotable ink fountain. Most specifically, the present invention is directed to a pivotable ink fountain supported by bearings secured to the shaft of the ink roller. The ink fountain roller support shaft extends outwardly from the ink fountain roller and is carried by suitable bearings in spaced side frames of the printing machine. Interiorly of the side frames, the roller support shaft carries support rings about which the ink fountain is supported by flexible connecting straps. A pair of spaced holding journals are resiliently received in side walls of the ink fountain and are secured to the side frames of the printing machine. These holding journals act as pivot points about which the ink fountain can move once it has been disconnected from the support rings. This mounting reduces ink fountain roller deflection. Since deflection is reduced, ink metering quality is improved.

DESCRIPTION OF THE PRIOR ART

Ink fountain assemblies for use in printing machines are generally well known in the art. An ink fountain roller is caused to rotate in an ink fountain which carries a supply of ink. Suitable means are provided to control the thickness of the film of ink which the roller carries away from the fountain. One such ink fountain assembly is shown in U.S. Pat. No. 4,058,058. An ink fountain roller and the ink fountain are both secured to spaced side frames of the printing machine. Ink adjusting elements are carried by the ink fountain and cooperate with the roller to adjust ink thicknesses on the roller. The ink fountain is capable of pivoting about means secured in the side frames.

Ink fountain assemblies such as the one described above do not always provide satisfactory ink thickness metering since the ink fountain roller is capable of deforming across its length due to the pressure exerted on it by the ink which is forced to pass through the relatively thin space between the metering elements and the ink fountain roller surface. This deflection of even a relatively thick ink fountain roller causes an increased ink flow with an accompanying reduction in printing quality and an accompanying increase in paper waste.

SUMMARY OF THE INVENTION

It is an object of the present invention to provide a bearing arrangement for an ink fountain in a rotary printing machine.

Another object of the present invention is to provide an ink fountain which is releasably secured to the ink fountain roller shaft.

A further object of the present invention is to provide a bearing arrangement for an ink fountain which reduces ink fountain roller deflection.

Yet another object of the present invention is to provide an ink fountain which is pivotably secured to the side frames of a rotary printing machine.

As will be discussed in greater detail in the description of the preferred embodiment as set forth hereinafter, the bearing arrangement for an ink fountain in a rotary printing machine in accordance with the present invention is comprised generally of an ink fountain roller and a cooperating ink fountain or reservoir. The ink fountain roller is carried by bearings secured in the side frames of the printing machine. Roller shaft journals interiorly of the side frames carry support rings on suitable ball bearings. Each of the support rings has a groove in the center of its periphery. Support straps are secured at a first end to the ink fountain, pass around the support rings and are carried at second ends in overcenter pivotable levers. As the support straps are tightened, the ink fountain is secured in place. The ink fountain is pivotably mounted by holding journals which are attached to the side frames at a first end and are resiliently positioned in side walls of the ink fountain at second ends.

A particular advantage of the ink fountain bearing arrangement in accordance with the present invention is that as a result of the reduction of surface area of the ink fountain roller in the ink fountain, the deflection of the ink fountain roller caused by the ink metering elements and the ink itself is reduced. Accordingly, the film of ink carried by the ink fountain roller is more uniform. A further advantage of the present invention is that although the ink fountain is carried on the ink fountain roller shaft, it is still capable of being pivoted off the ink fountain roller. Thus the ink fountain can be moved away from the ink fountain roller for cleaning, or servicing and the like.

BRIEF DESCRIPTION OF THE DRAWINGS

While the novel features of the bearing arrangement for an ink fountain in a rotary printing machine in accordance with the present invention are set forth with particularity in the appended claims, a full and complete understanding of the invention may be had by referring to the detailed description of a preferred embodiment, as set forth hereinafter, and as may be seen in the accompanying drawings in which:

DESCRIPTION OF THE PREFERRED EMBODIMENT

Figure 1:
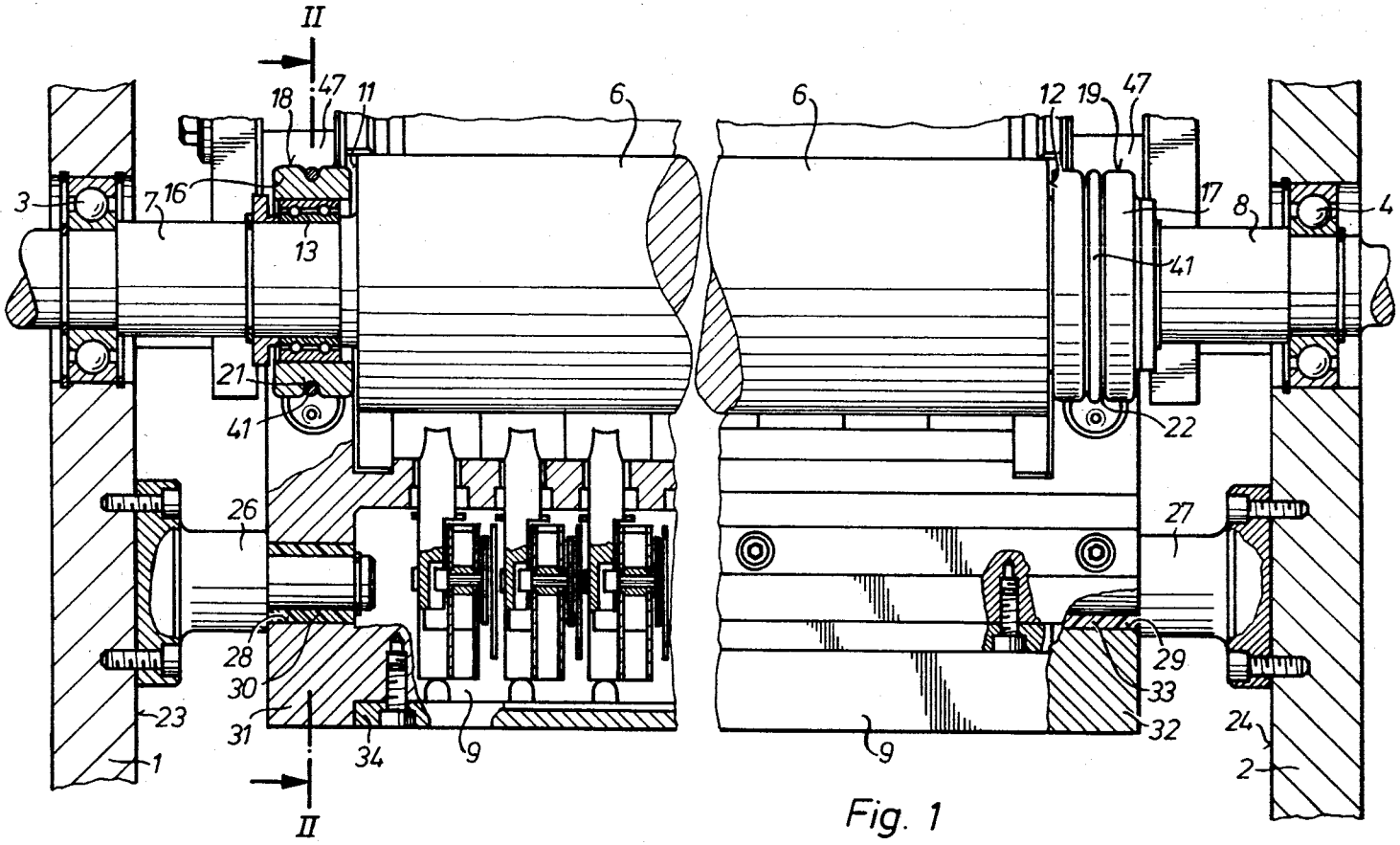
FIG. 1 is a front elevation view, partly in section of an ink fountain assembly in accordance with the present invention.

Turning initially to FIG. 1, there may be seen an ink fountain roller 6 which is supported in a generally conventional manner between spaced side frames 1 and 2 of a rotary printing machine. Outer ends of roller journals 7 and 8 of the ink fountain roller 6 are supported by bearings 3 and 4, respectively in the side frames 1 and 2. The ink fountain roller 6 is driven by any suitable known manner such as by the main drive of the printing machine or by an individual drive.

An ink fountain 9 is secured to the roller journals 7 and 8 instead of the side frames 1 and 2 as is the conventional arrangement. This securement of the ink fountain 9 to the ink roller journals 7 and 8 reduces the bearing area and hence the flexure length of the ink roller 6. The ink metering elements and the ink itself do not have as great an area within which to exert force on the ink fountain roller 6. The flexure length of the ink fountain roller bearings is also reduced so that the deflection of the ink fountain roller is substantially lessened.

A ball bearing assembly 13 is mounted on each of the ink roller journals 7 and 8 as near as possible, such as for example within 4–6 mm, of front surfaces 11 and 12 of the ink fountain roller. A supporting ring 16 or 17 is secured to the outer race of each of the ball bearing assemblies 13. Each supporting ring 16 or 17 is provided with a semi-circular groove 21 and 22 on the center of the periphery 18 or 19 of the support ring. Each semi-circular groove 21, 22 extends completely around the periphery 18, 19 of its respective support ring 16 or 17, as may be seen in FIGS. 1 and 2.

Figure 2:
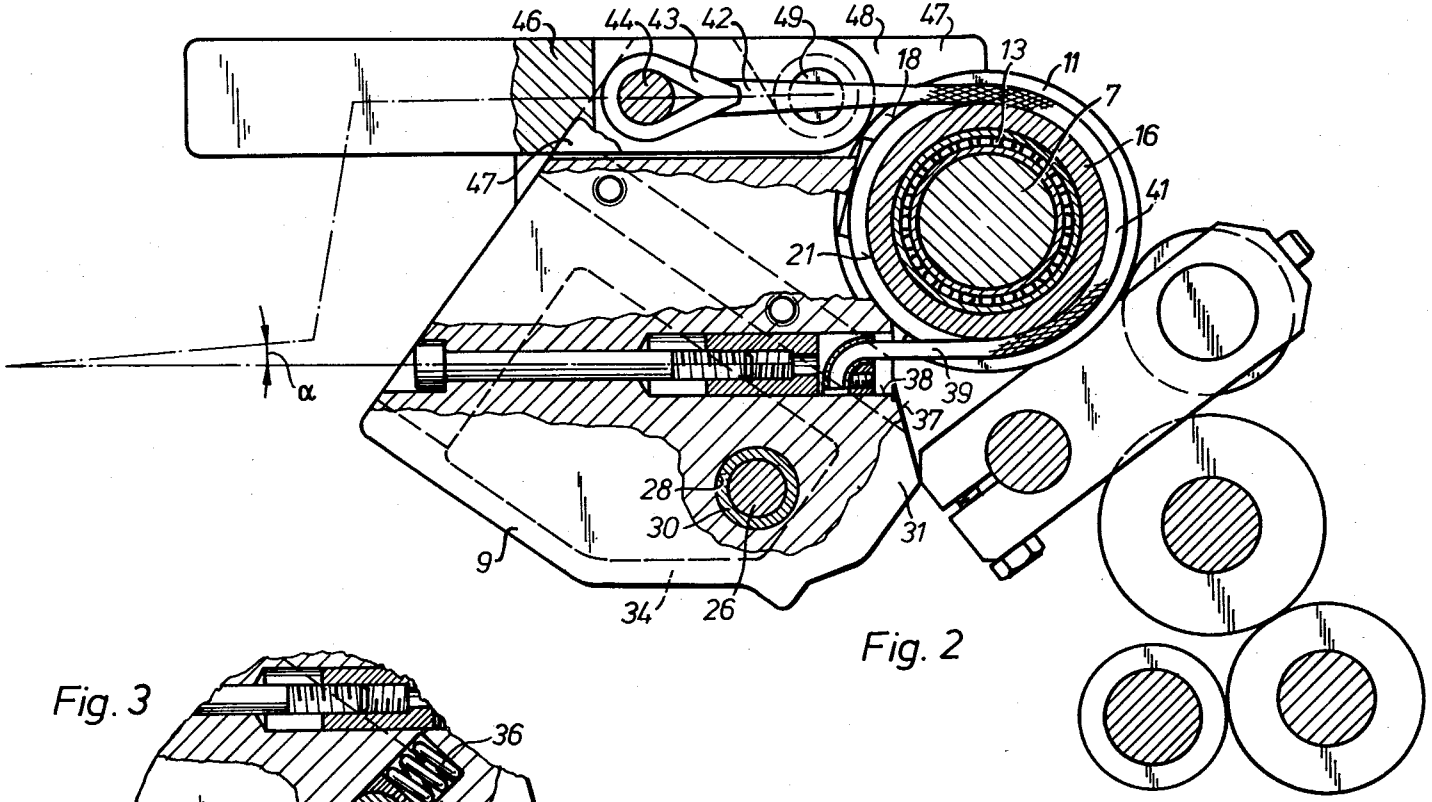
FIG. 2 is a vertical section of the ink fountain assembly of FIG. 1, taken along line II—II in FIG. 1.

An ink fountain, generally at 9, is pivotably supported between the two spaced side frames 1 and 2 by shouldered holding or support journals 26 and 27. Each support journal 26, 27 is secured to an inner face 23 and 24, respectively of the spaced side frames 1 and 2 by suitable means. The support journals 26, 27 are secured in boreholes 28 and 29 in side walls 31 and 32, respectively of the ink fountain 9. These boreholes 28, 29 are larger than the diameters of the corresponding support journals 26, 27 and suitable means are utilized to provide a resilient support for the support journals. In one embodiment, as seen in FIGS. 1 and 2, resilient plastic bushings 30 and 33 are pressed into boreholes 28 and 29. In this instance, the boreholes 28, 29 are approximately 8 mm larger than the cooperating support journals 26, 27. The plastic resilient inserts 30, 33 snugly engage the support journals 26, 27 yet still provide resilient support for the ink fountain 9 in the side frames 1 and 2.

Figure 3:
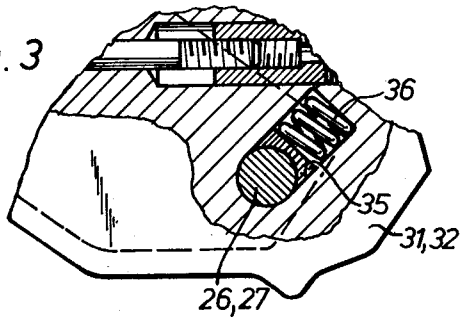
FIG. 3 is a vertical section view of an alternate embodiment of the holding journal bearing arrangement in accordance with the present invention.

In an alternative embodiment, as may be seen in FIG. 3, the support journals 26, 27 are received in elongated recesses 35 in the side walls 31, 32 of the ink fountain 9. A compression spring 36 is carried in each recess 35 with one end of the spring 36 bearing on an end wall of recess 35 while the other end of the spring 36 bears against the support journal 26, 27. This mount and the alternate embodiment shown in FIGS. 1 and 2 provide a resilient yet secure mount for ink fountain 9 in the spaced side walls 1 and 2 of the rotary printing machine. Thus the position of the ink fountain 9 is dependent on its mounting on the roller journals 7, 8 of the ink fountain roller 6 and not on the support journals 26, 27. The ink fountain 9 is, however, free to pivot about support journals 26, 27 after having been loosened from the roller journals 7 and 8.

The securement of the ink fountain 9 to the roller journals 7 and 8 will now be discussed. Since the securement means are the same for both journals 7 and 8, the discussion will be limited to securement about journal 7. It will, however, be understood that the ink fountain 9 will be secured to both roller journals 7 and 8 when the assembly is in operation.

As may be seen most clearly in FIG. 2, a first end 39 of a securement means 41 such as, for example, a flexible connecting strap in the form of a length of wire rope which is attached in a recess 38 in a front side 37 of the side wall 31 of ink fountain 9. This wire rope 41 is placed in the groove 21 on the surface of support ring 16 and passes around the surface of support ring 16 for approximately 180°. A second end of wire rope 41 is formed as a rope thimble or loop 43 and is caught on a stub journal 44 which is rigidly secured to a pivotable lever 46. This pivotable lever 46 is disposed in a laterally open recess 47 on an upper surface 48 of ink fountain 9 and is pivotable about a pivot shaft 49 which is secured to the ink fountain side wall. Pivotable lever 46 is pivotable in a manner such that the centerlines of the first and second ends 39 and 42 are not parallel to each other but instead are disposed at an acute angle $\alpha$ to each other.

In the latched position, as seen in FIG. 2, the lever 46 has been pressed downwardly beyond its dead center point so that it is securely held in place. In this manner, ink fountain 9 is securely fixed to the roller journals 7 and 8 of ink fountain roller 6. When it is desired to loosen the connection between the roller journal 7 and ink fountain 9, the pivotable lever 46 is caused to move in a clockwise direction. This movement of lever 46 causes the wire rope or other securement means 41 to rise out of groove 21 so that the thimble 43 can be removed from the stub journal 44. It will be understood that this must be done for both roller journals 7 and 8 so that the connection of the ink fountain 9 and the ink roller 6 can be released. The ink fountain 9 can then be freely pivoted about the support journals 26, 27 for any desired purpose such as cleaning, inspection or servicing.

It will be understood that other flexible means such as steel tapes, chains, belts and the like could be used as securement means 41 and that the means for securing the ends of the securement means 41 to the front side 37 of the ink fountain 9 and to the stub journal 44 could be varied depending on the specific securement means 41 used.

Thus it will be seen that the bearing arrangement in accordance with the present invention allows the ink fountain 9 to be secured to the ink fountain roller journals 7 and 8 in a secure but easily releasable manner. As discussed previously, this bearing arrangement results in reduced roller deflection and accordingly, provides more uniform and consistent ink metering with a resultant improvement in printing quality and a reduction of waste.

While a preferred embodiment of a bearing arrangement for an ink fountain in a rotary printing machine has been fully and completely described hereinabove, it will be obvious to one of skill in the art that a number of changes in for example, the specific bearing used, the type of securement means, the end fastenings for the securement means, and the like could be made without departing from the true spirit and scope of the invention and that the invention is to be limited only by the following claims.

I claim:

1. A bearing arrangement for a pivotable ink fountain in a rotary printing machine having a driven ink fountain roller plunging into said ink fountain, wherein a supporting ring is supported on either side of said fountain roller on a roller journal, each of said supporting rings carrying a securement means which wraps on a periphery of said supporting ring, a first end of said securement means being secured to said ink fountain, a second end of said securement means being connected to a tensioning device which is secured to said ink fountain so that said ink fountain is capable of being pivoted off said ink fountain roller.

2. A bearing arrangement in accordance with claim 5, wherein said ink fountain is provided with two side walls, each of which has one borehole in which an elastic bushing is located, said bushings engaging holding journals secured to side frames of said printing machine.

3. A bearing arrangement in accordance with claim 5, wherein said ink fountain is provided with two side walls which each have a recess for holding a holding journal, a compression spring being positioned in each said recess, the counter bearing of said spring being on said side wall of said ink fountain, the power action of said spring being on said journal.

4. A bearing arrangement in accordance with claim 1, wherein said supporting rings are provided with a groove on their circular periphery.

5. A bearing arrangement in accordance with claim 1, wherein said securement means is a wire rope.

6. A bearing arrangement in accordance with claim 5, wherein said securement means is a steel tape.

7. A bearing arrangement in accordance with claim 1, wherein said securement means is a chain.

8. A bearing arrangement in accordance with claim 2, wherein said bushings are plastic.

* * * * *